United States Patent [19]

Chandley

[11] Patent Number: 4,874,029

[45] Date of Patent: Oct. 17, 1989

[54] COUNTERGRAVITY CASTING PROCESS AND APPARATUS USING DESTRUCTIBLE PATTERNS SUSPENDED IN AN INHERENTLY UNSTABLE MASS OF PARTICULATE MOLD MATERIAL

[75] Inventor: George D. Chandley, Amherst, N.H.

[73] Assignee: General Motors Corporation, Detroit, Mich.

[21] Appl. No.: 191,544

[22] Filed: May 9, 1988

[51] Int. Cl.[4] ..... B22C 9/04; B22D 18/06

[52] U.S. Cl. ..... 164/34; 164/63; 164/119; 164/255; 164/306

[58] Field of Search ..... 164/7.1, 7.2, 34, 35, 164/36, 63, 255, 119, 306

[56] References Cited

U.S. PATENT DOCUMENTS

| | | | |
|---|---|---|---|
| 3,059,294 | 10/1962 | Dunn et al. . | |
| 3,181,213 | 5/1965 | Schaible et al. . | |
| 3,557,867 | 1/1971 | Krzyzanowski | 164/255 |
| 3,581,802 | 6/1971 | Krzyzanowski | 164/34 |
| 3,780,787 | 12/1973 | Rasmussen | 164/35 |
| 4,085,790 | 4/1987 | Wittmoser | 164/7.1 |
| 4,340,108 | 7/1982 | Chandley et al. | 164/63 |
| 4,566,521 | 1/1986 | Uzaki et al. | 164/160.1 |
| 4,589,466 | 5/1986 | Chandley et al. | 164/119 |
| 4,606,396 | 8/1986 | Chandley et al. | 164/255 |
| 4,616,689 | 10/1986 | Denis | 164/34 |
| 4,745,962 | 5/1988 | Mercer et al. | 164/255 |
| 4,787,434 | 11/1988 | Cleary et al. | 164/34 |

OTHER PUBLICATIONS

Kubo, Y. et al., Molding Unbonded Sand with Vacuum-The V-Process; American Foundry Society Transactions No. 73-126, 1973, pp. 529-544.

*Primary Examiner*—Richard K. Seidel
*Assistant Examiner*—J. Reed Batten, Jr.
*Attorney, Agent, or Firm*—Reising, Ethington, Barnard, Perry & Milton

[57] ABSTRACT

A countergravity casting process involves holding an inherently unstable mass of particulate mold material in an open bottom container around a destructible pattern therein by exerting external fluid pressure, such as atmospheric pressure, on a bottom side of the particulate mass in excess of internal pressure in the container. The container and an underlying molten metal pool are relatively moved to place the bottom side of the particulate mass in the pool. Molten metal is drawn through an ingate to the pattern to destroy and replace the pattern in the particulate mass. When the container and pool are relatively moved to extract the bottom side from the pool after casting, the particulate mold material is held in the container around the metal replacing the pattern by the external/internal pressure differential between the bottom side of the particulate mass and interior of the container. The particulate mold material and solidified metal therein are removed from the container by equalizing the external and internal pressures. Typically, atmospheric pressure is exerted on the bottom side of particulate mass while subatmospheric pressure is provided in the container.

101 Claims, 4 Drawing Sheets

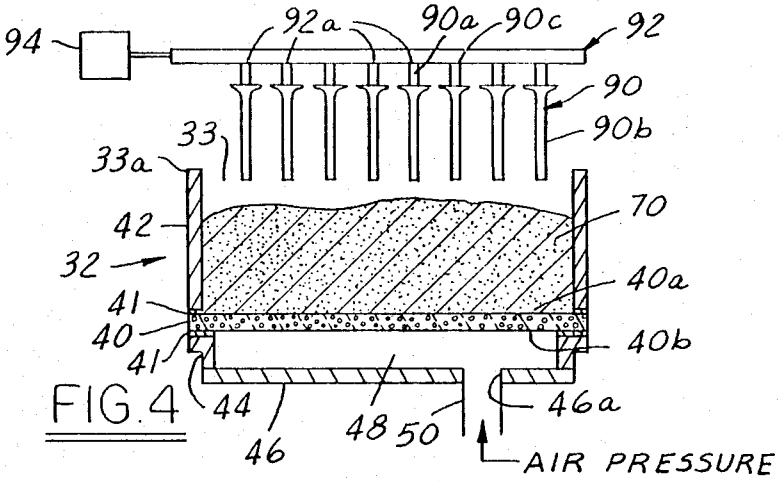
FIG. 4
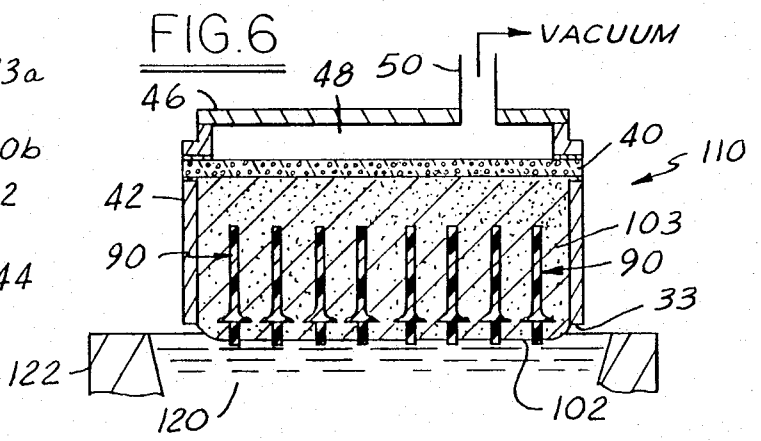
FIG. 6
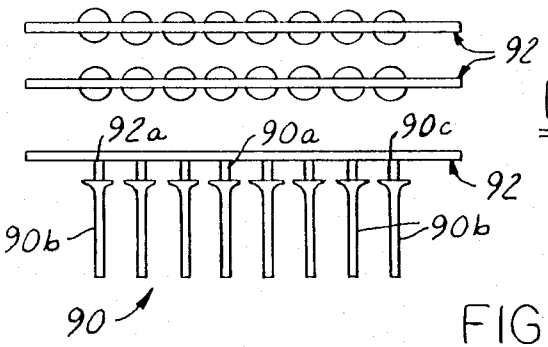
FIG. 3
FIG. 2
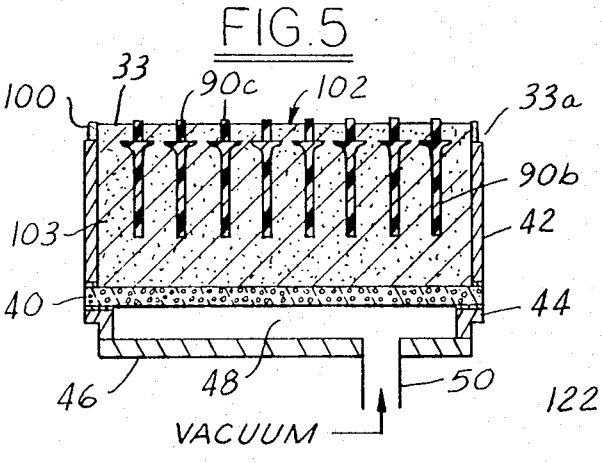
FIG. 5

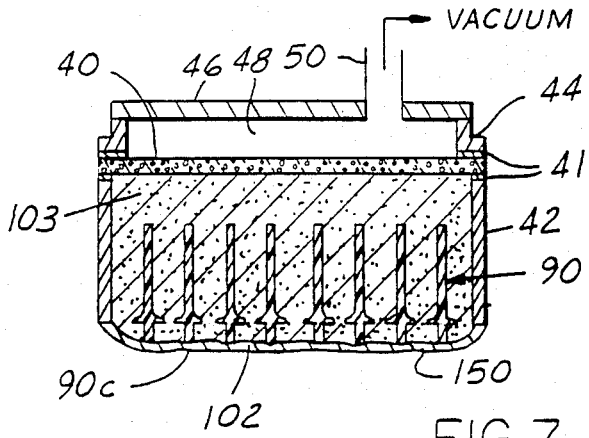
FIG. 7
FIG. 8
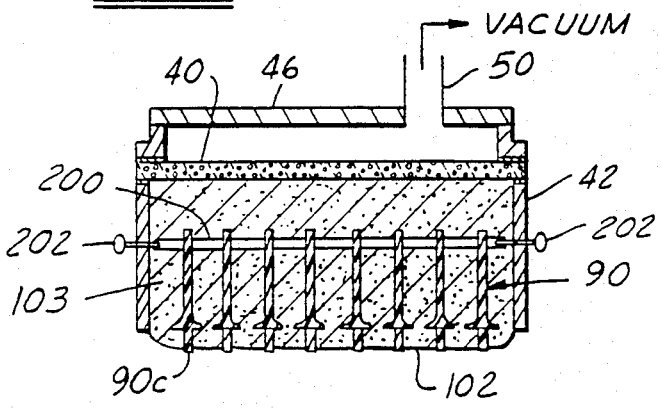
FIG. 9
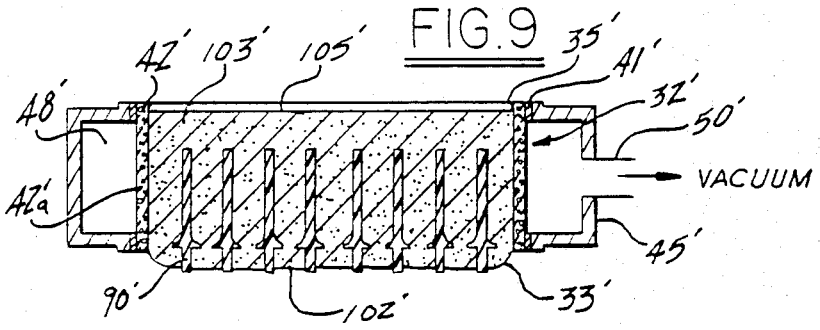

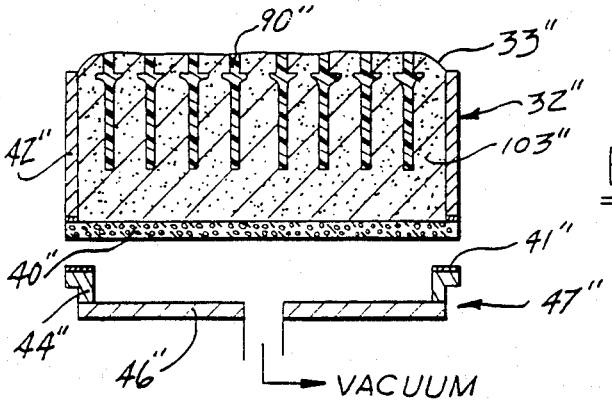
FIG. 10
FIG. 11
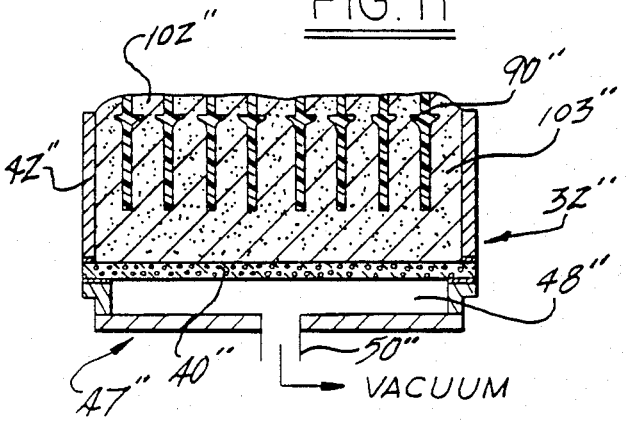
FIG. 12
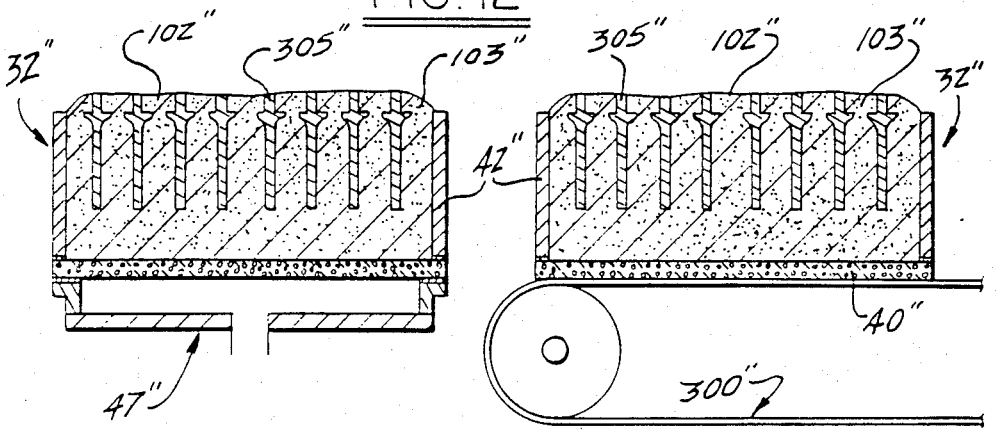

COUNTERGRAVITY CASTING PROCESS AND APPARATUS USING DESTRUCTIBLE PATTERNS SUSPENDED IN AN INHERENTLY UNSTABLE MASS OF PARTICULATE MOLD MATERIAL

FIELD OF THE INVENTION

This invention relates to the countergravity casting of metal in a gas permeable mold and, in particular, to a method and apparatus for countergravity casting using an inherently unstable mass of particulate mold material and a destructible pattern that is initially embedded in the particulate mass and subsequently displaced by molten metal drawn thereinto from an underlying molten metal pool during casting.

BACKGROUND OF THE INVENTION

A vacuum countergravity casting process using a gas permeable mold is described in such prior art patents as the Chandley et al U.S. Pat. No. 4,340,108 issued July 20, 1982 and U.S. Pat. No. 4,606,396 issued Aug. 19, 1986. That countergravity casting process is of the mold-immersion type and involves providing a mold having a porous, gas permeable upper mold member (cope) and a lower mold member (drag) secured together, sealing a vacuum chamber to the mold such that the vacuum chamber confronts the gas permeable upper mold member, submerging the bottom side of the lower mold member in an underlying molten metal pool and evacuating the chamber to draw molten metal through one or more ingate passages in the lower mold member and into one or more mold cavities formed between the upper and lower mold members. The mold used in that vacuum countergravity casting process typically includes a rigid, self-supporting, resinbonded upper mold member and lower mold member secured together by suitable means.

Another casting process, known in the art as the "lost foam" process, involves pouring molten metal into a foamed plastic pattern surrounded by a porous, unbonded (binder free) sand mold such that the molten metal destroys (vaporizes) the pattern and replaces it in the sand before the sand collapses. The solidified metal thus assumes the shape of the foamed plastic pattern and the pattern destruction products escape into the sand. The lost foam process has been proposed for use in conjunction with both gravity and countergravity poured metal as exemplified by Wittmoser U.S. Pat. No. 4,085,790 issued Apr. 25, 1987 and Denis U.S. Pat. No. 4,616,689 issued Oct. 14, 1986, respectively.

It is an object of the present invention to provide an improved, economical countergravity casting process of the mold-immersion type which essentially eliminates the need for costly mold-making particulate (e.g., resin-containing sand) and separate mold-making and mold-handling equipment as well as significantly reduces the time required to carry out the process.

It is another object of the present invention to provide an improved, economical countergravity casting process and apparatus wherein an inherently unstable mass of particulate mold material is held in an open bottom container around a destructible pattern therein by an external fluid pressure exerted on the bottom side of the mass in excess of internal pressure in the container and wherein the bottom side of the particulate mass is submerged in an underlying molten metal pool in such a way as to permit drawing molten metal to the pattern to destroy and replace it in the particulate mass.

SUMMARY OF THE INVENTION

The invention contemplates a method for the countergravity casting of molten metal comprising holding an inherently unstable mass of particulate mold material in an open bottom container around a destructible pattern therein by exerting an external fluid pressure on a bottom side of the mass exceeding the internal fluid pressure in the container, relatively moving the container and an underlying molten metal pool to place the bottom side of the mass in the molten metal, and drawing molten metal through an ingate between the bottom side and the pattern to destroy and replace the pattern in the mass when the bottom side is placed in the molten metal pool. As the container is withdrawn from the pool after casting, the particulate mold material is held around the metal replacing the pattern (i.e., the casting) in the mass by exerting external pressure on the bottom side of the mass in excess of internal pressure in the container. To remove the particulate mold material and solidified metal from the container, the external pressure and internal pressure are equalized to allow the mold material and solidified metal to fall by gravity from the container. By "inherently unstable" mass is meant a mass of unbonded, or weakly bonded, particulates which, in the context of the present invention, has insufficient internal cohesive strength to, by itself (i.e., without the aforesaid external-internal fluid pressure differential), support its own weight and that of a casting formed therein when the metal-filled mass is withdrawn from the underlying pool of metal. A preferred such mass comprises binderless, free-flowing sand which is economical to use, requires no curing operation and is readily recoverable for reuse. Weakly bonded particulates (e.g., sand) may also be used but at the expense of additional cost and process complexity.

In one embodiment of the method of the invention, the pattern and metal replacing the pattern during casting are supported in the container solely by the particulate mold material held therearound when the inverted container is suspended above the metal pool.

In another embodiment of the method of the invention, an ingate integral with the destructible pattern is exposed on the bottom side of the particulate mass for contact with the molten metal pool.

In still another embodiment of the method of the invention, ambient fluid pressure is exerted on the bottom side of the particulate mass and subambient fluid pressure is provided in the container to establish an external/internal pressure differential between the bottom side of the mass and the interior of the container sufficient to hold the particulate mold material around the pattern and metal replacing the pattern during casting when the inverted container is suspended above the metal pool.

The invention also contemplates a method for making a countergravity casting mold including positioning a container with an open end thereof facing upwardly, positioning a destructible pattern in the container, surrounding the pattern with a mass of particulate mold material in the container including forming an exposed, upwardly facing side on the mass proximate the open end of the container, exerting an external fluid pressure on the upwardly facing side of the particulate mass in excess of the internal pressure in the container, and inverting the container to face the open end of the container and the exposed side of the particulate mass downwardly for contacting an underlying molten metal pool, the particulate mass being held in the container around the pattern by the external/internal pressure differential.

The invention further contemplates a countergravity casting mold comprising a container having an open bottom end, an inherently unstable mass of the particulate mold material disposed in the container and having a bottom side for contacting an underlying molten metal pool, a destructible pattern embedded in the mass, ingate means between the pattern and the bottom side of the mass and means for exerting external fluid pressure on the bottom side exceeding the internal fluid pressure in the container to hold the particulate mold material in the container around the pattern. The container may have an open top end and an open bottom end to accommodate certain pattern configurations.

Apparatus for the countergravity casting of molten metal also contemplated by the invention includes the mold of the preceding paragraph, means for relatively moving the casting mold and an underlying molten metal pool to place the bottom side of the mass in the pool and means for drawing the molten metal through the ingate to the pattern to destroy and replace it in the mass when the bottom side is so positioned.

In one embodiment of the apparatus of the invention, the container includes a gas permeable upper end or a gas permeable side wall through which subambient pressure may be provided in the container by an adjacent vacuum chamber to establish the aforementioned external/internal pressure differential between the bottom side of the particulate mass and interior of the container.

In another embodiment of the apparatus of the invention, the bottom side of the particulate mass is disposed below the open bottom end of the container to contact the molten metal pool without having to contact the container with the molten metal pool during casting.

In still another embodiment of the apparatus of the invention, the particulate mold material may comprise binderless ceramic particulate of controlled size, preferably sand particulate whose size is less than about 40 mesh and greater than about 140 mesh, to permit retention of the particulate in the container around the pattern and the metal replacing the pattern during casting by the aforementioned external/internal pressure differential.

In a further embodiment of the apparatus of the invention, the casting apparatus includes means for moving the container successively about a vertical axis among a particulate and pattern loading station, a metal casting station and a particulate/casting unloading station as well as means for rotating the container about a horizontal axis to place the open end thereof in proper orientation at each station.

In a still further embodiment of the invention, a vacuum box is releasably sealingly engaged to a container such that a vacuum chamber is formed confronting a gas permeable portion of the container for evacuating the inside thereof. A mass of particulate mold material, either an inherently unstable mass or a bonded mass, is disposed in the container to form a mold therein having a mold cavity. The vacuum chamber is evacuated to draw molten metal into the mold cavity when a bottom side of the mold is immersed in an underlying molten metal pool. Following casting of the molten metal into the mold, the container is separated from the vacuum box to allow the metal cast into the mold cavity to cool slowly in the mass of particulate mold material in the container while the vacuum box is used to cast another mold.

BRIEF DESCRIPTION OF THE DRAWINGS

FIG. 2 is an elevational view of a plurality of destructible pattern assemblies for use in the invention.

FIG. 3 is a plan view of the pattern assemblies.

FIG. 4 is an elevational view of the pattern assemblies positioned for insertion into a container, shown in section, partially filled with particulate mold material.

FIG. 5 is similar to FIG. 4 with the patterns positioned in the container that is filled with the particulate mold material.

FIG. 6 is a sectioned elevational view of the particulate-filled container of FIG. 5 after inversion and immersion of the bottom side of the particulate mass facing into an underlying molten metal pool.

FIG. 7 is a view similar to FIG. 6 (without the molten metal pool) of another embodiment of the invention.

FIG. 8 is a view similar to FIG. 6 (without the molten metal pool) of still another embodiment of the invention.

FIG. 9 is a sectioned elevational view of a further embodiment of the invention using a container having open top and bottom ends.

FIG. 10 is a sectional elevational view of still further embodiment of the invention wherein a container and a vacuum chamber are separable from one another.

FIG. 11 is similar to FIG. 10 showing the container and vacuum chamber releasably sealingly engaged.

FIG. 12 is similar to FIG. 10 showing a metal filled container disengaged from the vacuum chamber and positioned on a conveyor for slow cooling of the metal in the particulate mold material in the container.

BEST MODE FOR PRACTICING THE INVENTION

Figure 1:
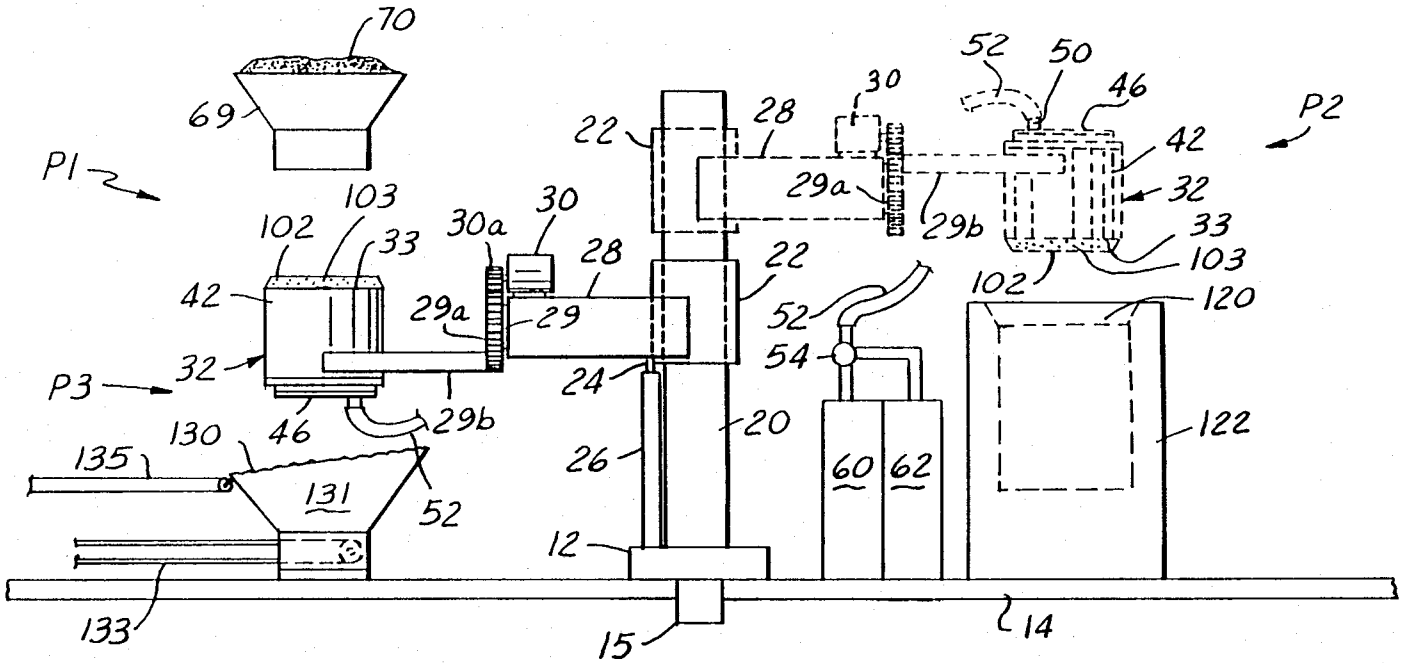
FIG. 1 is an elevational view of a countergravity casting machine of the invention with the view split into a left half showing loading and unloading stations P1,P3 and a right half showing a casting station P2.

Referring to FIG. 1, a countergravity casting apparatus in accordance with the invention is illustrated as including a rotatable base 12 disposed on a stationary support base 14. The base 12 is rotated by a rotary actuator 15 mounted on the stationary support base 14. An upstanding pedestal 20 is affixed on the rotatable base 12 for rotation therewith about a vertical axis. Slidably mounted on the pedestal 20 is an annular slide 22 which is moved vertically on the pedestal by the piston 24 of fluid cylinder 26. A horizontally extending support arm 28 is secured on the annular slide for movement therewith. An actuator shaft 29 is journaled in the outboard end of the support arm 28 for rotation about a horizontal axis. To this end, the actuator shaft includes a driven gear **29*a* thereon. A rotary actuator 30 is mounted on support arm 28 and includes driving gear 30*a* in driving mesh with the driven gear 29*a*. The rotary actuators 15 and 30** may comprise conventional fluid or electrical motors.

Actuator shaft 29 includes a shaft extension **29*b* onto which a tubular (e.g., cylindrical, parallelepipedal, etc.) container 32 is secured for rotation with the actuator shaft 29**.

FIG. 1 is vertically split into a left half showing the annular slide 22, support arm 28, actuator shaft 29 and container 32 positioned at a loading station P1 and a right half showing the same components at a casting station P2.

The components are positioned successively at the loading station P1 and then at the casting station P2 by rotation of the base 12. At the loading station P1, the container 32 is initially oriented with its open end 33 facing upwardly to receive particulate mold material while at the casting station P2, the container is oriented with its open end 33 facing downwardly for casting a will be explained below. Following casting at casting station P2, the components are moved to the unloading station P3 beneath the loading station P1, where the container is oriented with its open end 33 facing downwardly to unload the solidified castings and particulate mold material as also will be explained below. Rotary actuator 30 rotates the actuator shaft 29 to effect proper orientation of the container 32 at each station.

Although the loading station P1 and unloading station P3 are shown in FIG. 1 located atop one another and 180° from the casting station P2, those skilled in the art will appreciate that the loading station P1, casting station P2 and unloading station P3 can be arranged in other locations about the pedestal 20

Referring to FIGS. 1 and 4, the container 32 is shown at the loading station P1 with its open end 33 facing upwardly. The container 32 comprises a gas permeable end 40 fastened to an annular, gas impermeable wall 42 defining the open end 33 remote from the gas permeable end. Actuator shaft extension **29*a* is affixed to the annular wall 42 so as to support the container 32 therefrom. The gas permeable end 40 includes an inner side 40*a* and outer side 40*b*. An annular flange 44 is fastened to the gas permeable end 40 and a closure member 46 is fastened to the flange 44 so as to define a chamber 48 adjacent the outer side 40*b* of the gas permeable end 40. Suitable annular gaskets 41 are positioned between the components of the container 32** for vacuum sealing purposes.

The closure member 46 includes an aperture **46*a* in which a pipe 50 is sealingly received (e.g., welded). Sealingly received on the outboard end of the pipe 50 is a flexible hose 52 that extends to a valve 54. The hose 52 has a length sufficient to accommodate movement of the container 32 between the loading and unloading stations P1,P3 and casting station P2. The valve 54 is of a type to alternately interconnect a vacuum pump 60 or source of air pressure 62 to the hose 52 and thus to chamber 48 adjacent the gas permeable end of the container 32. Although the vacuum pump 60 and air pressure source 62 are shown mounted on the stationary base 14, they may be mounted on the rotatable base 12 to enable a shorter hose 52** to be used or may comprise central vacuum and pressure source located elsewhere in a manufacturing plant remote from the casting apparatus and servicing a variety of pieces of plant equipment as well.

The gas permeable end 40 of the container preferably comprises a porous alumina plate whereas the annular wall 42 and components forming chamber 48 comprise metal members.

As shown best in FIGS. 1 and 4, the container 32 is partially filled at the loading station P1 with binder free, free-flowing sand (i.e., the preferred particulate) or other ceramic particulate 70 useful as a mold material for the particular metal to be cast. The container 22 may be filled manually or from a hopper 69 containing the particulate 70.

The type of particulate mold material will depend on the type of molten metal being cast and can be selected to this end. For casting iron and steel, silica or other sand particulate is the preferred mold material. The particulate mold material is controlled in size as will be explained below.

With the container 32 partially filled with the particulate 70, a gas such as pressurized air from source 62 is introduced to chamber 48 through hose 52 and pipe 50 by suitable actuation of the valve 54. The air pressurizes chamber 48 and flows upwardly into the container 32 through the permeable wall 40 to cause the particulate 70 to become fluidized.

A plurality of destructible patterns 90 held on fixtures 92, FIGS. 2–4, are positioned by suitable transfer means (not shown) above the open end 33. The fixtures 92 may comprise elongate, hollow members having a plurality of vacuum ports **92*a* for releasably holding a pattern at each vacuum port. The interior of each fixture 92 may be connected to a common vacuum pump 94 to provide the vacuum holding action at each port 92*a***.

Each destructible pattern 90 comprises an ingate portion **90*a* and an article portion 90*b* having the shape of the article to be cast. The article portion 90*b* is shown for purposes of illustration only as shaped to define a poppet valve for an internal combustion engine. The ingate portion 90*a* may comprise an integral cylindrical portion extending from the article portion 90*b* to a respective vacuum port 92*a*. Various shapes for the ingate portion 90*a* and article portion 90*b* may be used. The ingate portion may be integral with or connected to the patterns and may comprise the same or different material. Although the ingate portions are illustrated as integral with the patterns and thus destructible during casting, non-destructible ingate portions which must be removed subsequently from the casting can be employed, although this is not preferred. For example, hollow ceramic or metal ingate tubes (not shown) may extend from the patterns in like manner as ingate portions 90*a*. Each pattern may comprise multiple ingate portions 90*a* and/or multiple article portions 90*b***.

The destructible patterns 90 preferably comprise a material, such as a foamed plastic material (e.g., expanded polysytrene) which vaporizes under the heat of the molten metal but may comprise any other material that melts, decomposes, sublimes or is otherwise destroyed by the molten metal and is removed through the pores of the particulate mass. The article portion **90*b* may include one or more inserts and the like made of metal or other materials to be incorporated in the final casting or removed therefrom to form a void therein. The article portion 90*b*** of the patterns may be coated with a coating to impart a desired surface to the metal casting.

With the particulate 70 partially filling the container 32 and fluidized therein as described hereinabove, the fixtures 92 are lowered by suitable means (not shown) to set the patterns 90 in position in the sand particulate to the desired depth with the particulate surrounding each pattern, FIG. 5. Alternately, the container 32 can be raised to insert the patterns to the desired depth. Preferably, the patterns are positioned in the container to a depth that allows the ingate portions **90*a* to extend above the open end of the container 32 (i.e., above annular end lip 33*a*** of the container).

After the patterns are set in the container to the desired depth, the air flow to chamber 48 is discontinued by actuating valve 54. Fluidization of the particulate is thereby discontinued.

Prior to filling the remainder of the container with particulate 70, a temporary annular extension 100 of the wall 42 having an inner diameter or dimension substantially equal to that of the open end 33 is placed atop the horizontal end lip 33*a*. The particulate 70 is then added to the container to a level slightly below the upper end of the extension 100, as shown best in FIG. 5, to form an exposed upwardly facing side 102 on the particulate mass 103 proximate the open end 33 of the container. As is apparent, exposed side 102 of the mass 103 is located above the open end 33 of the container and slightly below the upper ends 90*c* of the ingate portions 90*a* of the destructible patterns. In this way, the ends 90*c* of the integral ingate portions are exposed on side 102 of the particulate mass 103.

Although some patterns may require fluidization of the sand particulate in the partially filled container during pattern positioning, other patterns may require only vibration of the container 32 as the patterns are inserted therein. Therefore, fluidization of the particulate during pattern positioning is optional and will depend upon the nature of the particular pattern involved (e.g., its size and/or complexity).

During and possibly following filling of the container 32 to the level shown in FIG. 5, it may be necessary to vibrate the container 32 to enhance packing of the particulate 70 around the patterns, especially if the patterns have a complex shape.

Those skilled in the art will appreciate that embedding of the patterns in the binderless particulate mass can be effected in other ways. For example, the patterns and particulate mold material may be introduced into the container 32 with the open end 33 facing downwardly and temporarily closed by a suitable closure member. The particulate mold material and pattern would be placed in the container through the upper end thereof by using a removable gas permeable end 40 on the container. Once the patterns are embedded, the gas permeable end is fastened over the upper end of the container and the relative vacuum is provided in the container. The temporary closure member would then be removed from the open end 33 to expose the bottom side of the particulate mass for contact with an underlying molten metal pool.

After the patterns 90 have been embedded in the particulate to the level shown in FIG. 5 to form the exposed side 102, the patterns are freed or released from the fixtures 92 by terminating the vacuum inside the fixtures. The fixtures 92 are then removed from the patterns 90.

A vacuum is then drawn in chamber 48 by actuating valve 54 to connect the chamber 48 to the vacuum pump 60 through pipe 50 and hose 52. As a result, a relative vacuum (i.e., subatmospheric pressure) is applied in the container 32 through the gas permeable end 40 while atmospheric pressure is applied on the upwardly facing exposed side 102 of the particulate mass 103. The amount of vacuum drawn is sufficient to retain the particulates in the container 32 upon inversion thereof and will vary with the size and weight of the particulates and of the finished casting and, to some extent, the area of the open end 33 of the container 32.

Thereafter, annular extension 100 is removed from the open end 33 for re-use or disposal. The container 32 is then raised and rotated at the loading station P1 to orient its open end 33 and the exposed side 102 of the mass 103 in a downwardly facing direction. The container 32 is then preferably vibrated to remove any loose particulates from the exposed side 102 before transferring the container 32 to the casting station P2.

FIG. 6 illustrates the countergravity casting mold 110 provided by the mold making steps described hereinabove. The casting mold 110 includes the open bottom container 32 and the gas permeable, particulate mass 103 held in the container around the freed patterns 90 as a result of the external atmospheric pressure on the exposed side 102 of the mass 103 exceeding the internal subatmospheric pressure in the container. It is apparent that exposed side 102 of the particulate mass has become the bottom side of the casting mold and is located below the open bottom end 33 of the container 32. The particulate mass 103 held in the container by the aforementioned external/internal pressure differential solely retains and supports the patterns in position in the container 32.

In making the countergravity casting mold 110 of FIG. 6, the size of binderless particulate mold material 90 is controlled so as to preclude its falling out of the open bottom 33 of the container on the one hand or being drawn into the gas permeable upper end 40 on the other. For a particular round silica sand particulate commonly used in casting iron and steel, particle sizes less than about 40 mesh AFS and larger than about 140 mesh AFS have proved satisfactory to this end. A more preferred range of such sand particle sizes is about 50 mesh AFS to about 70 mesh AFS. The particular range of particle sizes useful for a particular application in accordance with the invention will depend on the type and shape of the particulate mold material used, the pore size of the permeable end 40 and the vacuum level established in the container. Smaller particle sizes are preferred for casting metals having higher melting points. Particle shape also may be varied in practicing the invention.

The vacuum applied to the chamber 48 must be at least sufficient to draw molten metal to the top of the molding cavity formed by the pattern and to exert an upward force on the bottom side 102 of the mass 103 which is at least equal to the combined weight of the mass 103 and the casting(s) formed therein. Vacuum levels in the chamber 48 of about 7.3 inches of mercury and above have been found acceptable to hold the aforesaid 40–140 mesh sand particulate (i.e., about 25 lbs. of sand) in the container (i.e., 18 inch diameter cylindrical container) around the pattern without the particulate falling out of the open bottom of the container 32 and to support castings therein weighing about 21 lbs.

Although the particulate mass 103 is illustrated as being held in the container by providing subambient pressure in the container, those skilled in the art will appreciate that external fluid pressure on the bottom side of the mass may be increased relative to internal pressure in the container to achieve the desired external/internal pressure differential. Hence, for example, suitable means for providing super-atmospheric air pressure on the bottom side 102 of the particulate mass 103 while maintaining atmospheric pressure in the container could be used to this end.

As mentioned above, the bottom side 102 of the particulate mass 103 is located below the open bottom end 33 of the container in FIG. 6. This feature of the countergravity casting mold 110 permits submersion of the bottom side 102 of the particulate mass and exposed ends 90c of the patterns in an underlying molten metal pool 120 in container 122 without having to contact the annular wall 42 of the container 32 with the molten metal.

The countergravity casting mold 110 is moved from the loading station P1 to the casting station P2 by rotation of the base 12 and is raised to the desired height above the molten metal pool by piston 24. At the casting station P2, the bottom side 102 of the particulate mass 103 and exposed ends 90c of the patterns face the underlying molten metal pool 120. In accordance with the countergravity casting process of the invention, the casting mold 110 and the molten metal pool 120 are relatively moved to immerse the bottom side 102 of the particulate mass 103 in the molten metal pool. In the exemplary embodiment illustrated, the annular slide 22 is lowered by the piston 24 to lower the casting mold 110 toward the molten metal pool 120 to submerge the bottom side 102 and exposed ends 90c of the patterns therein as shown in FIG. 6. Since subatmospheric pressure is maintained in the container 32 while atmospheric pressure is exerted on the molten metal pool 120 during submersion, molten metal is drawn toward and through the ingate portions 90a to vaporize, decompose or otherwise remove them as the metal advances and eventually is drawn to the article portions 90b to destroy and replace them in the particulate mass. The products of pattern vaporization or decomposition are drawn into the gas permeable particulate mass 103 and possibly into the vacuum chamber 48 for discharge through the vacuum system.

After solidification of the molten metal replacing the patterns 90, the casting mold 110 is withdrawn (raised) from the pool 120 by extending piston 24. During this operation, the subatmospheric pressure still is maintained in the container 32 to hold the particulate mass 103 around the metal replacing the patterns in the particulate mass. The particulate mass thereby solely retains and supports the metal in position in the container after casting.

In an alternative embodiment for larger castings, the casting mold may be withdrawn from the molten metal pool after initial solidification of the ingates while the metal replacing the article portions 90b is still molten. The number and size of the ingate portions 90a to achieve initial solidification at the casting ingates will vary with the type of article to be cast and the particular metal to be cast as explained in U.S. Pat. No. 4,340,108, the teachings of which are incorporated herein by reference.

Although the molten metal is described hereinabove as being drawn to the patterns 90 by the same vacuum in the container 32 that holds the sand particulate therein, those skilled in the art will appreciate that the invention is not so limited. Additional external pressure could be applied to facilitate the movement of molten metal into the patterns with or without the subambient pressure present in the container. Suitable means for providing superatmospheric pressure may be provided to this end.

Following withdrawal of the metal-filled casting mold 110 from the molten metal pool 120, the base 12 is rotated and the piston 24 lowered to position the casting mold at the unloading station P3 where the open end 33 of the container faces downwardly toward an open grid or screen 130. The subambient pressure (vacuum) is then released to provide atmospheric pressure in the container 32. This equalization of the external and internal pressure causes the particulate mass and solidified metal to fall by gravity out of the container 32 through open bottom end 33 onto the open grid 130. The grid 130 allows the particulate mold material 103 to pass therethrough to a lower hopper 131 while retaining the castings on top thereof. The particulate mold material can be transferred by conveyor 133 or other suitable transfer means from the lower hopper to the upper hopper 69 above the loading station P1 for reuse. The metal castings may be transferred by a conveyor 135 or other suitable transfer means from grid 130 to finishing stations (not shown).

The empty container 32 is then rotated by actuator shaft 29 to place open end 33 facing upwardly toward hopper 69 to repeat the loading, casting and unloading cycle described hereinabove.

FIG. 7 illustrates another embodiment of the invention differing from that described with reference to FIGS. 1-6 in that the gas permeability of the bottom side 102 of the casting mold 110 is reduced by applying a layer 150 thereon which has a lower gas permeability than that of the particulate mass 103. The lower gas permeability layer 150 preferably is applied to side 102 at the loading station P1 and may comprise a ceramic slurry sprayed onto side 102 or an organic adhesive applied on side 102, leaving ends 90c of the patterns exposed. Alternatively, as shown in FIG. 7, a destructible sheet or film may be held onto side 102 by the external/internal pressure differential established when the vacuum is drawn inside the container 32. The sheet is destroyed when the bottom side of the particulate mass is submerged in the molten metal pool to thereby uncover the exposed ends 90c of the pattern on the bottom side of the mass for contact with the molten metal. A preferred destructible sheet 150 for countergravity casting of iron and steel comprises aluminum foil. Aluminum foil is preferred since it does not melt until it contacts the molten pool. Use of such a foil layer 150 permits a greater percentage of the area of the bottom side 102 of the particulate mass to comprise pattern ingates to increase the number of castings per mold or provide improved molten metal supply to the same number of castings.

The preferred countergravity casting process (i.e., with binderless particulates) and apparatus of the invention described hereinabove are advantageous since no rigid, self-supporting, resin-bonded mold components are required to cast complex shapes. Elimination of resin-bonded mold components reduces the cost of the mold materials, eliminates resin curing steps from the overall process and minimizes the presence of gases in the casting otherwise generated when resin-bonded mold components are thermally-degraded during casting by the heat of the molten metal. Such gases are highly detrimental to casting quality, and their minimization is highly advantageous. Furthermore, the nature of the present invention permits ingates for supplying molten metal to the patterns to be provided in myriad locations instead of from a single fill passage as is required for gravity casting techniques. Finally, since rigid, bonded mold components, ceramic fill tubes, molten metal seals and the like are not required, a less complex and costly countergravity casting process and apparatus are provided by the invention.

In the detailed description hereinabove, the freed destructible patterns 90 are embedded in the particulate mass 103 which solely supports and retains the patterns in position in the container as a result of the external- /internal pressure differential established. Although not preferred, it is possible to support the patterns in position in the particulate mass using one or more fixturing members 200 as shown in FIG. 8 which may remain in the container 32 during the casting process. Such fixturing members can be made of ceramic or other material and are releasably mounted on the container by, for example, threaded thumb screws 202. The patterns could be mounted to the fixturing members by adhesive or other suitable means.

In the embodiment of FIG. 8, the particulate mass 103 is held around the patterns 90 by the aforementioned external/internal pressure differential as described hereinabove. However, the fixturing members 200 retain the patterns in position. Upon submersion of the bottom side 102 of the casting mold in the molten metal pool, metal will be drawn to the patterns to destroy and replace them in the mass 103 as described hereinabove. The metal replacing the patterns may be supported in the particulate mass by the fixturing members if the metal becomes attached to the fixturing members. If it does not become attached thereto, the particulate mass retains the metal in position. Upon withdrawal of the casting mold from the pool 120, the particulate mass, solidified metal and fixturing members can be removed from the container at the unloading station P3 by releasing the fixturing members from their mounting on the container and equalizing the external pressure and internal pressure such that the particulate mass, solidified metal and fixturing members fall by gravity out of the container through the open bottom end 33. The castings are thereafter removed from the fixturing member 200 as may be required.

FIG. 9 illustrates a further embodiment of the invention differing from that described hereinabove in that a container 32' having an open bottom end 33' and open top end 35' is used. In FIG. 9, like reference numerals are used to represent like features of FIGS. 1–6. The container 32' includes an annular side wall 42' which includes a gas permeable portion **42*a*. An annular vacuum box 45' is sealingly secured on the side wall 42' to form a peripheral vacuum chamber 48' around the gas permeable portion 42*a'* as shown. The vacuum chamber 48' is communicated by a conduit 50' to a vacuum pump (not shown). A plurality of destructible patterns 90' are embedded in the particulate mass 103' which includes an exposed bottom side 102' for immersion in a molten metal pool and an exposed top side 105'. As described hereinabove with respect to FIGS. 1–6, a sufficient vacuum is drawn in the chamber 48' to retain the particulate mass 103' and the patterns 90', and ultimately the metal castings replacing the patterns, in the container 32' as the container 32' is moved from the loading station P1 to the casting station P2 and then to the unloading station P3 shown in FIG. 1. Loading of the open-ended container 32' at the loading station P1 may occur through either end 33',35' of the container 32' as explained hereinabove for FIGS. 1–6 and may occur before or after the container and the vacuum box are sealingly engaged. A metal foil, plastic film or similar gas impermeable sheet (not shown), may be placed on the top side 105' of the particulate mass 103'. Those skilled in the art will appreciate that some pattern configurations may be more readily accommodated by the open-ended container 32' of FIG. 9 than by the container 32 of FIGS. 1–6**.

FIGS. 10–12 illustrate a further embodiment of the invention where like reference numerals double primed are used to represent like features of FIGS. 1–6. In FIGS. 10–12, a container 32'' and a vacuum box 47'' are separable from one another as shown best in FIG. 10. The container 32'' includes a gas permeable end 40'' fastened to an annular, gas impermeable wall 42'' that defines an open end 33''. The vacuum box 47'' includes end enclosure 46'' and an integral annular flange 44'' that carries an annular sealing gasket 41'' thereon. When the vacuum box 47'' is sealingly engaged to the container 32'', a vacuum chamber 48'' is formed adjacent the gas permeable end 40'' of the container 32''.

In the embodiment of FIGS. 10–12, the container 32'' is oriented with its open end 33'' facing upwardly and is filled with the particulate mass 103'' and with a plurality of destructible patterns 90'' therein as described hereinabove for FIGS. 1–6. The vacuum box 47'' is raised on a support arm (such as for example the support arm 28 of FIG. 1) to sealingly engage the vacuum box 47'' and the gas permeable end 40,, of the container 32'', FIG. 11. The vacuum chamber 48'' formed therebetween is evacuated by a vacuum pump (not shown) connected to conduit 50''. The vacuum drawn in the vacuum chamber 48'' is preferably sufficient to hold the container 32'' to the vacuum box 47'' and also to hold the particulate mass 103'' in the container 32'' around the patterns 90'' to form a casting mold when the container 32'' with the vacuum box 47'' sealingly engaged thereto is rotated to a casting position (e.g., see FIG. 6) and the exposed side 102'' of the particulate mass 103,, immersed in the molten metal pool (also see FIG. 6) to carry out the casting process as described hereinabove for FIGS. 1–6.

After casting, the container 32'' is moved away from the molten metal pool to withdraw the exposed side 102'' therefrom and the container is rotated to orient the open end 33'' and exposed side 102'' of the particulate mass 103'' upwardly. The container 32'' is moved adjacent to a conveyor 300'' where the vacuum is released from the vacuum chamber 48'' to free the particulate and metal-filled container 32'' (having metal castings 305'' therein) for transfer to the conveyor 300'' with the open end 33'' facing upwardly, FIG. 12, and with the gas permeable end 40'' supported on the conveyor 300'' The conveyor 300'' will move the particulate and metal-filled containers 32'' to an unload station (not shown) where each container 32'' is inverted to discharge the cooled metal castings 305'' and particulate mass 103'' through the downwardly facing open end 33''.

The embodiment of FIGS. 10–12 is advantageous in that the castings can be allowed to stay in the particulate mass 103'' in each container 32'' for a prolonged period of time to slowly cool in the particulate mass 103''; e.g., to cool the castings in the particulate mass 103'' for an hour or longer. Such slow cooling of the castings in the particulate mass 103'' may be required for many alloys and casting configurations. Since a plurality of particulate and metal-filled containers 32'' can be cooled slowly on the conveyor 300'' (or at a remote location) while the vacuum box 47'' is used for casting other molds, the throughput of the process is not adversely affected.

While the invention is preferably practiced using unbonded (i.e., binderless) particulates held within the container solely by the aforesaid external-internal differential pressure, the process may also be practiced using weakly bonded particulates without departing from the invention. In this regard, particulates may be mixed or coated with a small amount of binder (i.e., less than about 0.3% by weight of the sand-resin mix depending on the binder) which is sufficient to provide some tacking of the particles together but which is insufficient to form a mass which, by itself, is capable of supporting its own weight and that of the casting formed therein after the inverted container 32 has been extracted from the metal pool. The use of small amounts of binder is less preferred than binderless materials because it increases the cost and complexity of the process. Nonetheless some binder will (1) reduce the likelihood of loose particulates falling from the mold and into the metal pool, (2) broaden the range of particle sizes useful with the process, and (3) add some degree of cohesiveness to the mass to supplement the support provided by the external-internal pressure differention. Accordingly, in some instances it may be desirable to include the binders.

Binder-bearing sands useful with the process of the present invention preferably comprise those having chemically set/cured resin systems such as:

1. a phenolic and isocyanate resin mix cross-linked by passing an amine (e.g., triethylamine) vapor therethrough to form a phenolic-urethane binder (e.g., the ISOCURE® binder system by Ashland Chemcial Co.);
2. phenolic resin polymerized with methylformate gas passed therethrough to form a phenolic-ester resin (e.g., the BETASET® binder system by the Borden Chemical Co.);
3. "no bake" systems wherein a phenolic resin and an ester are premixed just prior to introduction into the container 32 (e.g., the ALPHASET® binder system by the Borden Chemical Co.); and
4. mixtures of acrylic epoxy resin, hydroperoxide and silane cured by passing, $SO_2$ gas therethrough (e.g., the ISOSET® binder system by Ashland Chemical Co.).

When gas/vapor cured systems are used, the curing gas/vapor is passed through the sand-resin mix via the permeable wall 40 after the pattern has been embedded therein as described in copending U.S. patent application Ser. No. 191,468 filed concurrently herewith in the name of Lawrence B. Plant and assigned to the assignee of the present invention. So-called "no-bake" systems are allowed to stand until cured after the pattern(s) have been embedded therein. After curing, the aforesaid mass-retaining, external-internal pressure differential is established and the remainder of the process carried out essentially as described above.

While the embodiment of FIGS. 10–12 has been described hereinabove as having an inherently unstable mass 103″ of particulate mold material in the container 32″, those skilled in the art will appreciate that a casting mold made of a fully bonded particulate mold material; e.g., a resin bonded sand mold, having one or more mold cavities therein can be used in lieu of the inherently unstable mass 103″ of particulate mold material in the container 32″; for example in accordance with the method of the aforementioned copending U.S. patent application Ser. No. 191,468.

While the countergravity casting apparatus of the invention is illustrated in FIG. 1 as including the central upstanding pedestal 20 having the annular slide 22 with the support arm 28, actuator arm 29 and container 32 thereon, those skilled in the art will appreciate that a pair of such upstanding pedestals 20 can be provided on the rotatable base 12 in spaced apart relation thereon. Each pedestal would have the annular slide 22 slidably mounted thereon with a respective support arm 28, actuator arm 29 and container 32 carried on the annular slide 22. The annular slide 22, support arm 28 and actuator arm 29 on one pedestal would be oriented to position an empty container 32 associated therewith at the particulate loading station P1 or a metal-filled container 32 at the unloading station P3 while the annular slide 22 support arm 28 and actuator arm 29 on the other pedestal would be oriented to position the particulate-filled container associated therewith at the metal casting station P2. The rotatable base 12 is rotated 180° to reposition the particulate-filled container formerly at the loading station P1 to the casting station P2 and the metal-filled container formerly at the casting station P2 to the unloading station P3 to carry out the respective loading, casting and unloading operations described in detail hereinabove. Since the loading or unloading of the container 32 on one pedestal can be carried out at loading or unloading station P1 or P3 while the particulate-filled container on the other pedestal is being filled with metal at the casting station P2, such a dual pedestal countergravity casting apparatus can provide increased production of castings.

While the invention has been described in terms of specific preferred embodiments thereof, it is not intended to be limited thereto but rather only to the extent set forth hereafter in the following claims.

I claim:

1. A method for the countergravity casting of molten metal comprising:

(a) holding an inherently unstable mass of particulate mold material in an open bottom container around a destructible pattern therein by exerting external fluid pressure on a bottom side of the mass exceeding the internal pressure in said container, (b) relatively moving the container and an underlying molten metal pool to place said bottom side in the molten metal pool, and (c) drawing molten metal through an ingate between the bottom side and the pattern to destroy and replace the pattern in said mass when the bottom side is placed in the molten metal pool.

2. The method of claim 1 including the step of relatively moving the container and molten metal pool after the metal replaces the pattern in the mass to withdraw the bottom side from the molten metal pool, including exerting external fluid pressure on said bottom side in excess of said internal pressure to hold the particulate mold material in the container around the metal during withdrawal.

3. The method of claim 2 including the step of equalizing the external pressure and internal pressure after withdrawal of the bottom side to cause the particulate mold material and metal to discharge from the container by gravity.

4. The method of claim 3 wherein said material comprises substantially binderless sand.

5. The method of claim 1 including supporting the pattern in the container solely by the particulate mold material being held therearound.

6. The method of claim 1 including exposing a portion of the pattern on the bottom side of the mass to form an ingate on said bottom side.

7. The method of claim 1 wherein the external pressure exceeds the internal pressure by exerting ambient pressure on the bottom side and providing subambient pressure in the container.

8. The method of claim 1 wherein the external fluid pressure on the bottom side exceeding the internal pressure holds the particulate mold material in the container around the pattern and also urges the molten metal toward the pattern when the bottom side is placed in the pool.

9. The method of claim 1 including contacting the bottom side of the mass with the molten metal pool without contacting the container with the molten metal pool.

10. The method of claim 1 wherein the mass of particulate mold material is disposed around the pattern by positioning the container with the open bottom facing upwardly, positioning the pattern in the container, filling the container with the particulate mold material including forming an upwardly facing side on said mass proximate the upwardly facing open bottom of the container, exerting the external pressure on said side in excess of the internal pressure in the container and inverting the container to orient the open bottom facing downwardly whereby said side becomes the bottom side of said mass.

11. The method of claim 10 wherein said material comprises substantially binderless sand.

12. The method of claim 10 wherein the pattern is positioned in the container with the particulate mold material fluidized therein.

13. The method of claim 12 wherein the particulate mold material is fluidized by directing pressurized air upwardly in the container.

14. The method of claim 1 including the step of reducing the gas permeability of the bottom side of the mass.

15. The method of claim 14 wherein the gas permeability is reduced by providing a layer on the bottom side, said layer having reduced gas permeability compared to said mass.

16. The method of claim 15 wherein the layer is provided by holding a destructible sheet of reduced gas permeability material on the bottom side.

17. The method of claim 16 wherein the destructible sheet is a metallic foil.

18. The method of claim 1 further including exerting said external pressure on a top side of the mass exposed through an open top end of said container.

19. The method of claim 18 further including evacuating the container between said open top end and open bottom end to provide said external pressure exerted on the top side and bottom side of said mass in excess of said internal pressure.

20. The method of claim 18 further including placing a gas impermeable sheet on the top side of said mass.

21. A method for the countergravity casting of molten metal comprising:

(a) holding an inherently unstable mass of particulate mold material in an open bottom container around a vaporizable pattern therein by exerting ambient fluid pressure on a bottom side of the mass and providing subambient pressure in said container, (b) relatively moving the container and an underlying molten metal pool to place said bottom side in the molten metal pool, and (c) drawing molten metal through an ingate between said bottom side and pattern to vaporize and replace the pattern in said mass with said metal when the bottom side is placed in the molten metal pool.

22. The method of claim 21 including supporting the pattern and the metal replacing the pattern during casting in the container solely by the particulate mold material being held therearound.

23. The method of claim 22 wherein said material comprises substantially binderless sand.

24. A method for the countergravity casting of molten metal comprising:

(a) holding an inherently unstable mass of sand in an open bottom container around a vaporizable pattern therein by exerting atmospheric pressure on a bottom side of the mass and providing subatmospheric pressure in said container, (b) exposing a portion of the pattern on the bottom side of the mass, (c) relatively moving the container and an underlying molten metal pool to place said bottom side and exposed portion of the pattern in the molten metal pool, and (d) drawing molten metal into said mass so as to vaporize said pattern and replace it in said mass with said metal when the bottom side and exposed portion of the pattern are placed in the molten metal pool.

25. The method of claim 24 including supporting the pattern and the metal replacing the pattern during casting in the container solely by the sand being held therearound.

26. A method of claim 25 wherein said sand contains substantially no binder.

27. A method for making a countergravity casting mold comprising:

(a) surrounding a destructible pattern with an inherently unstable mass of particulate mold material in an open bottom container, and (b) exerting an external fluid pressure on a bottom side of the mass exceeding the internal pressure in the container to hold the particulate mold material in the container around the pattern.

28. The method of claim 27 wherein said material contains substantially no binder.

29. The method of claim 27 including supporting the pattern in the container solely by the particulate mold material being held therearound.

30. The method of claim 27 wherein said external pressure is ambient pressure and said internal pressure is subambient pressure.

31. The method of claim 30 wherein said ambient pressure is atmospheric pressure.

32. The method of claim 27 including shaping the particulate mold material to form the bottom side below the bottom of the container.

33. The method of claim 27 further including exerting said external pressure on a top side of the mass exposed through an open top end of said container.

34. The method of claim 33 further including evacuating the container between said open top end and open bottom end to provide said external pressure exerted on the top side and- bottom side of said mass in excess of said internal pressure.

35. The method of claim 33 further including placing a gas impermeable sheet on the top side of said mass.

36. A method for making a countergravity casting mold comprising:

(a) positioning a container with an open end thereof facing upwardly, (b) surrounding a destructible pattern with an inherently unstable mass of particulate mold material in the container, including forming an upwardly facing side on said mass proximate said open end, (c) exerting an external fluid pressure on said side of the mass in sufficient excess of the internal pressure in the container to hold the particulate mold material in the container around the pattern upon inversion of the container, and (d) inverting the container such that said side faces downwardly for contacting an underlying molten metal pool.

37. The method of claim 36 including fluidizing and defluidizing said mass to embed said pattern in said mass.

38. The method of claim 36 wherein said material comprises substantially binderless sand.

39. The method of claim 36 including supporting the pattern in the inverted container solely by the particulate mold material being held therearound.

40. The method of claim 36 wherein the external pressure is ambient pressure and the internal pressure is subambient pressure.

41. The method of claim 36 including exposing a portion of the pattern on said side of the mass.

42. The method of claim 41 including placing a removable annular extension on the upwardly facing open end, positioning said portion of the pattern above said extension, filling said extension with the mold material and removing said extension after establishing the external pressure in excess of the internal pressure.

43. A countergravity casting mold comprising:

(a) a container having an open bottom end, (b) an inherently unstable mass of particulate mold material defining a metal-receiving molding cavity in the container, said mass having a bottom side for contacting an underlying molten metal pool, (c) a destructible pattern embedded in the mass and shaping said cavity, (d) ingate means between said pattern and bottom side, and (e) means for establishing a negative pressure differential between the inside and the outside of said container sufficient to hold the particulate mold material in the container around the pattern.

44. The mold of claim 43 wherein the pattern is supported in the container solely by the particulate mold material held therearound.

45. The mold of claim 43 wherein the bottom side of said mass is below the open bottom end of the container.

46. The mold of claim 43 wherein the particulate mold material comprises ceramic particulate.

47. The mold of claim 46 wherein the ceramic particulate comprises sand.

48. The mold of claim 47 wherein the sand is less than about 40 mesh and greater than about 140 mesh in size and contains substantially no binder.

49. The mold of claim 48 wherein the sand is less than about 50 mesh and greater than about 70 mesh in size.

50. The mold of claim 43 wherein said means for establishing said differential pressure includes means for providing a subambient pressure in the container.

51. The mold of claim 50 wherein the container includes a gas permeable wall intermediate said means for providing subambient pressure and said mass.

52. The mold of claim 51 wherein said means for providing subambient pressure includes a vacuum chamber adjacent the gas permeable wall.

53. The mold of claim 51 wherein the gas permeable wall comprises an upper end of the container.

54. The mold of claim 43 wherein the pattern is a vaporizable material.

55. The mold of claim 54 wherein the vaporizable material is foamed plastic.

56. The mold of claim 43 wherein the container is rotatably mounted to orient the open end facing upwardly for filling with the particulate mold material.

57. The mod of claim 43 wherein said means for establishing said differential pressure serves to draw said molten metal toward the pattern and comprises means for providing subambient pressure in the container.

58. The mold of claim 57 wherein said means for providing subambient pressure comprises vacuum pump means for evacuating the container.

59. The mold of claim 43 wherein said container further includes an open top end and a side wall between said open top end and open bottom end.

60. The mold of claim 59 wherein the side wall is gas permeable.

61. The mold of claim 60 wherein said means for establishing a negative pressure differential comprises a peripheral vacuum chamber adjacent the gas permeable side wall.

62. The mold of claim 43 wherein the container includes said open bottom end, a vacuum box and means for releasably sealingly engaging the vacuum box and container to form a vacuum chamber therebetween.

63. The casting mold of claim 62 wherein said means for releasably engaging the vacuum box and the container comprises means for evacuating the vacuum chamber.

64. A countergravity casting apparatus, comprising:

(a) a container having an open bottom end, (b) an inherently unstable mass of particulate mold material in the container, said mass having a bottom side for contacting an underlying molten metal pool, (c) a destructible pattern embedded in the mass, (d) ingate means between said pattern and said bottom side, (e) means for exerting an external fluid pressure on said bottom side of the mass exceeding the internal pressure in the container to hold the particulate mold material in the container around the pattern, (f) means for relatively moving the container and the molten metal pool to place the bottom side of the mass in the molten metal pool, and (g) means for drawing molten metal through the ingate means to the pattern to destroy and replace it in said mass with said metal when said bottom side is placed in the molten metal pool.

65. The apparatus of claim 64 wherein the pattern and the metal replacing the pattern are supported in the container solely by the particulate mold material held therearound.

66. The apparatus of claim 64 wherein said means for exerting the external pressure exceeding the internal pressure and said means for drawing molten metal toward the pattern comprise means for providing subambient pressure in the container.

67. The apparatus of claim 66 wherein the container includes a gas permeable wall disposed between said means for providing subambient pressure and said mass.

68. The apparatus of claim 67 wherein the gas permeable wall comprises an upper end of the container.

69. The apparatus of claim 68 wherein the gas permeable wall comprises a side wall of the container.

70. The apparatus of claim 67 wherein said means for providing subambient pressure includes a vacuum chamber disposed adjacent the gas permeable wall.

71. The apparatus of claim 64 including means for relatively moving the container and molten metal pool to extract the bottom side of the mass from the molten metal pool.

72. The apparatus of claim 71 including means for equalizing the external pressure and internal pressure after the bottom side is extracted to discharge the particulate mold material and solidified metal from the container by gravity.

73. The apparatus of claim 64 further including means for moving the container between a particulate loading station and a metal casting station.

74. The apparatus of claim 73 wherein said means for moving the container comprises means for rotating the container about a vertical axis.

75. The apparatus of claim 73 further including means for rotating the container about a horizontal axis to orient the open bottom end facing upwardly at the loading station to receive said particulate mold material and to invert the container to orient the open bottom end thereof facing downwardly at the metal casting station whereby the bottom side of the particulate mass faces the molten metal pool.

76. The apparatus of claim 75 further including a casting unloading station to which the container is moved from the casting station and said means for rotating the container about the horizontal axis places the open bottom end facing downwardly at the unloading station for discharging the particulate mold material and metal replacing the pattern therethrough.

77. A countergravity casting apparatus, comprising:

(a) a container having an open bottom end, (b) an inherently unstable mass of particulate mold material in the container, said mass having a bottom side facing downwardly toward an underlying molten metal pool, (c) a vaporizable pattern embedded in the mass with a portion of the pattern exposed on said bottom side, (d) means for providing subambient pressure in the container to hold the particulate mold material in the container around the pattern and around the metal replacing the pattern during casting to retain them in said container, (e) means for relatively moving the container and molten metal pool to place the bottom side of the mass and exposed portion of the pattern in the molten metal pool, and (f) means for drawing molten metal toward the pattern to vaporize and replace it with said metal in said mass when said bottom side and exposed portion of the pattern are in contact with the molten metal pool.

78. A countergravity casting apparatus, comprising:

(a) a container having a gas permeable upper end and an open bottom end, (b) an inherently unstable mass of sand in the container, said mass having a bottom side facing downwardly toward an underlying molten metal pool and having an upper side adjacent the gas permeable upper end, (c) a vaporizable pattern positioned in the mass with a portion of the pattern exposed on said bottom side, (d) means adjacent the gas permeable upper end for providing subambient pressure in the container to hold the sand in the container around the pattern and around the metal replacing the pattern to retain them in said container and to draw molten metal toward the pattern to destroy and replace it in said mass when said bottom side and exposed portion of the pattern are in contact with the molten metal pool, and (e) means for relatively moving the container and molten metal pool to place the bottom side of the mass and exposed portion of the pattern in the molten metal pool.

79. A method for the countergravity casting of molten metal comprising:

(a) providing a gas permeable mold in a container having an open bottom end such that a bottom side of said mold faces an underlying molten metal pool, (b) releasably sealingly engaging a vacuum box and the container to form a vacuum chamber confronting a gas permeable portion of the container for evacuating a mold cavity in the mold through said gas permeable portion, (c) relatively moving the underlying molten metal pool and the container to place the bottom side of said mold in the molten metal pool, (d) evacuating the vacuum chamber when the bottom side is placed in the molten metal pool to draw molten metal through an ingate between the bottom side and the mold cavity in said mold to fill said mold cavity with said metal, (e) relatively moving the molten metal pool and the container to withdraw the bottom side of said mold from the molten metal pool, (f) disengaging the container and the vacuum box, and (g) cooling said metal in the mold in said disengaged container.

80. The method of claim 79 including supporting the container in step (g) with its open bottom end facing upwardly while said metal cools in the mold therein.

81. The method of claim 80 wherein the container is supported in step (g) on an end thereof remote from the open bottom end.

82. The method of claim 80 wherein the container is supported in step (g) on a moving conveyor.

83. The method of claim 79 including, after step (f), the step of releasably sealingly engaging the vacuum box with another container.

84. The method of claim 79 including sealingly engaging the vacuum box to a gas permeable end of the container remote from the open bottom end thereof.

85. The method of claim 79 wherein the vacuum box and container are sealingly engaged by evacuating the vacuum chamber.

86. The method of claim 85 including establishing ambient pressure in the vacuum chamber before disengaging the container and the vacuum box.

87. The method of claim 79 wherein said mold comprises an inherently unstable mass of particulate mold material held in the container by evacuating the vacuum chamber.

88. The method of claim 87 wherein said inherently unstable mass comprises substantially binderless sand.

89. The method of claim 79 wherein said mold comprises a bonded mass of particulate mold material.

90. The method of claim 79 wherein the mold cavity is formed in said mass by embedding a destructible pattern in said mass to define said mold cavity.

91. A method for the countergravity casting of molten metal comprising:

(a) releasably sealingly engaging a vacuum box and a container having an open end and a gas permeable portion to form a vacuum chamber confronting said gas permeable portion for evacuating the inside of the container through said gas permeable portion, (b) evacuating the vacuum chamber to establish a negative pressure differential between the inside and outside of the container sufficient to hold an inherently unstable mass of particulate mold material in the container around a destructible pattern therein with a side of said mass exposed proximate the open end of said can, (c) orienting the container with said mass held therein such that the exposed side of said mass faces an underlying molten metal pool, (d) relatively moving the underlying molten metal pool and the container with said mass held therein to place the exposed side of said mass in the molten metal pool, (e) drawing molten metal through an ingate between the exposed side and the pattern to destroy and replace the pattern in said mass with said metal when the exposed side is placed in the molten metal pool, (f) relatively moving the molten metal pool and the container with said mass held therein around said metal to withdraw the exposed side of said mass from the molten metal pool, (g) disengaging the container and the vacuum box, and (h) cooling said metal in the mass of particulate mold material in said disengaged container.

92. A countergravity casting apparatus, comprising:

(a) a container having an open bottom end and a gas permeable portion, (b) a gas permeable mold disposed in the container, said mold having a bottom side for immersion in an underlying molten metal pool and having a mold cavity therein, (c) ingate means between said mold cavity and said bottom side, (d) a vacuum box releasably sealingly engaged to the container to form a vacuum chamber confronting the gas permeable portion of said container for evacuating the mold cavity through said gas permeable portion of said container, (e) means for relatively moving the molten metal pool and the container to place the bottom side of the mold in the molten metal pool, (f) means for evacuating the vacuum chamber to draw molten metal through the ingate means into the mold cavity in said mold to fill said mold cavity with said metal when said bottom side is placed in the molten metal pool, (g) means for relatively moving the molten metal pool and the container to extract the bottom side of the mold from the molten metal pool, (h) means for disengaging the container and the vacuum box, and (i) means for supporting the disengaged container as the said metal cools in the mold in said disengaged container.

93. The apparatus of claim 92 wherein the gas permeable portion of said container comprises an end of said container opposite from said open end.

94. The apparatus of claim 92 wherein the container is supported on the gas permeable end during cooling of said metal therein.

95. The apparatus of claim 92 wherein said vacuum box and container are sealingly engaged by evacuating said vacuum chamber.

96. The apparatus of claim 95 wherein said means for disengaging the vacuum box and the container comprises means for providing ambient pressure in the vacuum chamber.

97. The apparatus of claim 92 wherein said means for supporting the disengaged container comprises a conveyor.

98. The apparatus of claim 92 wherein said mold comprises an inherently unstable mass of particulate mold material held in the container.

99. The apparatus of claim 98 wherein said inherently unstable mass comprises substantially binderless sand.

100. The apparatus of claim 92 including a destructible pattern embedded in the mold to form said mold cavity therein.

101. A countergravity casting apparatus, comprising:

(a) a container having an open bottom end and a gas permeable portion, (b) an inherently unstable mass of particulate mold material in the container, said mass having a bottom side for contacting an underlying molten metal pool, (c) a destructible pattern embedded in the mass, (d) ingate means between said pattern and said bottom side, (e) a vacuum box releasably sealingly engaged to the container to form a vacuum chamber confronting the gas permeable portion of said container for evacuating the inside of the container to establish a negative pressure differential between the inside and outside thereof sufficient to hold the mass of particulate mold material in the container around said pattern, (f) means for relatively moving the molten metal pool and the container with said mass held therein to place the bottom side of the mass in the molten metal pool, (g) means for drawing molten metal through the ingate means to the pattern to destroy and replace it in said mass with said metal when said bottom side is placed in the molten metal pool, (h) means for relatively moving the molten metal pool and the container with said mass held therein around said metal to extract the bottom side of the mass from the molten metal pool, (i) means for disengaging the container and the vacuum box, and (j) means for supporting the disengaged container as said metal cools in the mass of particulate mold material in said disengaged container.

* * * * *

UNITED STATES PATENT AND TRADEMARK OFFICE

CERTIFICATE OF CORRECTION

PATENT NO. : 4,874,029

DATED : October 17, 1989

INVENTOR(S) : George D. Chandley

It is certified that error appears in the above-identified patent and that said Letters Patent is hereby corrected as shown below:

Column 11, line 40, change "42a" to --42a'--.
Column 12, line 19, change "40,," to --40"--.
Column 12, line 29, change "103,," to --103"--.
Column 18, line 4, change "mod" to --mold--.

Signed and Sealed this

Sixth Day of November, 1990

*Attest:*

HARRY F. MANBECK, JR.

*Attesting Officer*

*Commissioner of Patents and Trademarks*